US008779987B2

(12) United States Patent
Endo et al.

(10) Patent No.: US 8,779,987 B2
(45) Date of Patent: Jul. 15, 2014

(54) MULTIPLY RESONANT ANTENNA DEVICE AND ELECTRONIC DEVICE INCLUDING SUCH AND ANTENNA DEVICE

(75) Inventors: Natsumi Endo, Sagamihara (JP); Hiroyuki Hotta, Hamura (JP); Koichi Sato, Tachikawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 346 days.

(21) Appl. No.: 13/279,890

(22) Filed: Oct. 24, 2011

(65) Prior Publication Data

US 2012/0194390 A1 Aug. 2, 2012

(30) Foreign Application Priority Data

Feb. 1, 2011 (JP) ..... 2011-019881

(51) Int. Cl.
*H01Q 1/38* (2006.01)

(52) U.S. Cl.
USPC ..... 343/700 MS; 343/702

(58) Field of Classification Search
USPC ..... 343/700 MS, 702, 843, 846
See application file for complete search history.

(56) References Cited

U.S. PATENT DOCUMENTS

| | | | | |
|---|---|---|---|---|
| 6,552,686 | B2 * | 4/2003 | Ollikainen et al. | 343/700 MS |
| 7,050,010 | B2 * | 5/2006 | Wang et al. | 343/702 |
| 7,701,401 | B2 * | 4/2010 | Suzuki et al. | 343/702 |
| 7,936,318 | B2 * | 5/2011 | Kwan et al. | 343/895 |
| 2007/0188388 | A1 * | 8/2007 | Feng et al. | 343/700 MS |
| 2012/0249393 | A1 * | 10/2012 | Hotta et al. | 343/843 |

FOREIGN PATENT DOCUMENTS

| | | |
|---|---|---|
| JP | 2004-201278 | 7/2004 |
| JP | 2006-33069 | 2/2006 |
| JP | 2006-504328 | 2/2006 |
| JP | 3775795 | 3/2006 |
| JP | 2007-13643 | 1/2007 |
| JP | 2007-13847 | 1/2007 |
| JP | 2009-77225 | 4/2009 |
| JP | 2009-182608 | 8/2009 |
| JP | 2009-290522 | 12/2009 |

OTHER PUBLICATIONS

Japanese Office Action issued Jan. 31, 2012, in Japan patent Application No. 2011-019881 (with English translation).

* cited by examiner

*Primary Examiner* — Tan Ho
(74) *Attorney, Agent, or Firm* — Oblon, Spivak, McClelland, Maier & Neustadt, L.L.P.

(57) ABSTRACT

According to one embodiment, a multiply resonant antenna device according to the embodiment includes a first antenna element formed from a monopole element, a second antenna element formed from a parasitic element placed at a position where it can be current-coupled to the first antenna element, and a third antenna element formed from a folded monopole element. The length of the first antenna element is set to nearly a ¼ of wavelength corresponding to the first resonant frequency. The length of the second antenna element is set to nearly a ¼ of wavelength corresponding to the second resonant frequency. The electrical length of the third antenna element from the feed point to a ground point through a folding end is set to nearly a ½ of wavelength corresponding to the third resonant frequency higher than the first and second resonant frequencies.

18 Claims, 20 Drawing Sheets

Analysis parameter X = 7, 10, 12 [mm]

Analysis parameter Y = 15, 18, 25 [mm]

<Arrangement in which distal end of monopole element is folded>

<Arrangement in which distal end of monopole element is folded>

<Arrangement in which distal end of monopole element is formed into a meandering design>

<Arrangement in which distal end of folded element is open>

<Arrangement in which distal end of folded element is folded>

<Arrangement in which stub is provided between folded elements>

<Arrangement in which parasitic element is folded>

<Arrangement in which parasitic element is formed into a meandering design>

<Arrangement in which a plurality of stubs are provided>

<Arrangement in which stub is made to have width>

<Arrangement in which folded element is folded in Y-direction>

MULTIPLY RESONANT ANTENNA DEVICE AND ELECTRONIC DEVICE INCLUDING SUCH AND ANTENNA DEVICE

CROSS-REFERENCE TO RELATED APPLICATIONS

This application is based upon and claims the benefit of priority from Japanese Patent Application No. 2011-019881, filed Feb. 1, 2011; the entire contents of which are incorporated herein by reference.

FIELD

Embodiments described herein relate generally to a multiply resonant antenna device and an electronic device including the antenna device.

BACKGROUND

Recently, the housings of portable terminal devices typified by cellular phones, smartphones, and personal digital assistants (PDAs) have been required to have reduced dimensions and weight from the viewpoint of compactness and lightness. Accordingly, demands have arisen for more compact antenna devices. It has also been required to allow a single portable terminal device to communicate with a plurality of radio systems using different frequency bands.

Under these circumstances, conventionally, for example, a multiply resonant antenna device has been proposed, which is designed to implement multiple resonance by combining a monopole element having a plate-like design formed on the feed point side with a parasitic element. In addition, there has been proposed a multiply resonant antenna device which is obtained by combining a monopole element with a folded monopole element and providing a parasitic element in a direction opposite to the monopole elements. There has also been proposed an antenna device which includes an antenna plate having an inverted trapezoidal design provided for a feed point, and generates a plurality of resonant frequencies by using a short side and lateral side of the antenna plate as radiative elements.

The conventionally proposed antenna devices have the following problems. That is, as the antenna device obtained by combining the monopole element and the parasitic element is reduced in profile, the distance between the monopole element and the ground pattern decreases, resulting in a decrease in antenna impedance at the feed point. In addition, depending on the resonant frequency of the parasitic element, parallel resonance occurs between two resonant frequencies generated by the monopole element. This leads to deterioration in radiative efficiency.

The antenna device including the monopole element, folded monopole element, and parasitic element is configured to make the folded monopole element generate the lowest resonant frequency, and hence the folded monopole element has a long element length, resulting in an increase in the size of the antenna device. In addition, since the parasitic element has a small influence on the monopole element and the folded monopole element, it is difficult to implement a continuous wide band.

An antenna plate having an inverted trapezoidal design provided for the feed point requires a large area for installation. It is therefore difficult to reduce the size of the corresponding antenna device. In addition, this device exhibits low radiative efficiency at a resonant frequency as compared with a general multiply resonant antenna independently provided with an antenna element.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, a multiply resonant antenna device according to the embodiment includes a first antenna element formed from a monopole element, a second antenna element formed from a parasitic element placed at a position where it can be current-coupled to the first antenna element, and a third antenna element formed from a folded monopole element. The length of the first antenna element is set to nearly a ¼ of wavelength corresponding to the first resonant frequency. The length of the second antenna element is set to nearly a ¼ of wavelength corresponding to the second resonant frequency. The electrical length of the third antenna element from the feed point to a ground point through a folding end is set to nearly a ½ of wavelength corresponding to the third resonant frequency higher than the first and second resonant frequencies.

First Embodiment

Figure 1:
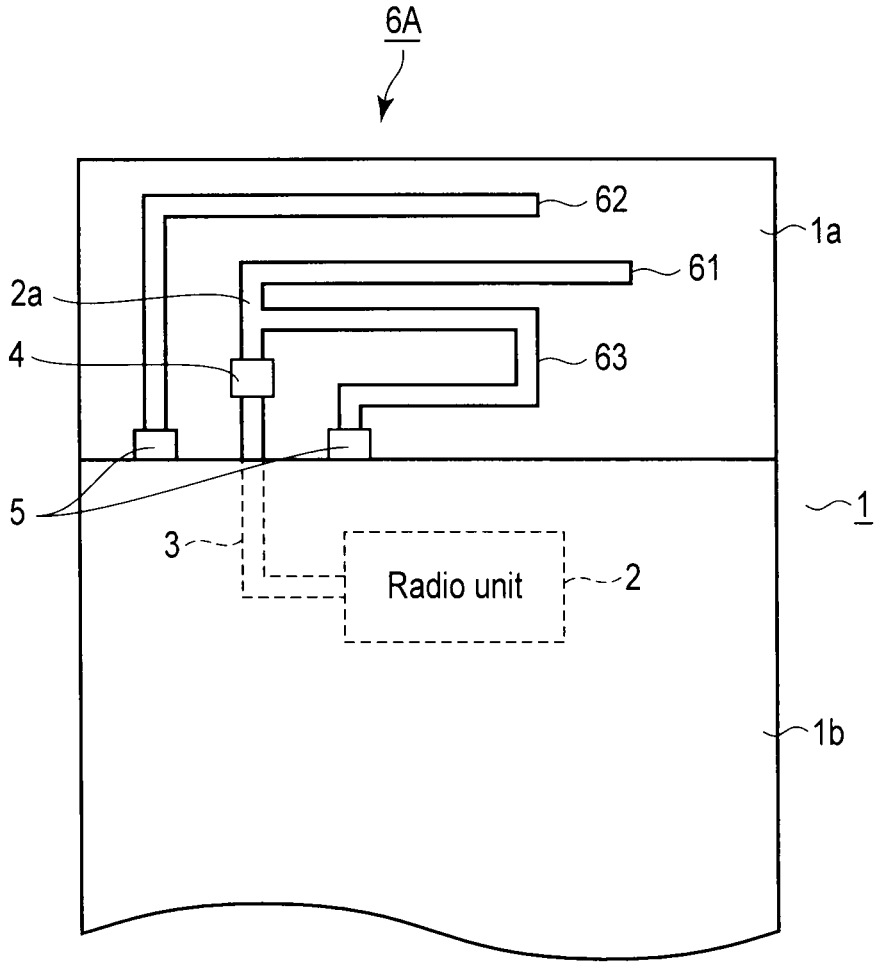
FIG. 1 is a view showing the arrangement of the main part of an electronic device including an antenna device according to the first embodiment.

FIG. 1 is a view showing the arrangement of the main part of an electronic device including a multiply resonant antenna device according to the first embodiment. This electronic device includes a notebook personal computer or television receiver including a radio interface. The housing (not shown) of this device accommodates a printed circuit board 1. Note that the electronic device may be a portable terminal such as a cellular phone, smart phone, PDA (Personal Digital Assistant), or electronic book reader other than a notebook personal computer or television receiver.

The printed circuit board (PC board) 1 includes a ground pattern portion 1*b* and a dielectric portion 1*a* on which no ground pattern is formed. A multiply resonant antenna device 6A is provided on the dielectric portion 1*a*. Note that a plurality of circuit modules necessary to form a portable terminal are mounted on the lower surface side of the printed circuit board 1. The circuit modules include a radio unit 2. The radio unit 2 has a function of transmitting and receiving radio signals by using the channel frequency assigned to a radio system as a communication target. The dielectric portion 1*a* is also provided with a feed terminal 4 (as a feed point) and ground terminals 5. The radio unit 2 is connected to the feed terminal 4 via a feed pattern 2*a*.

The multiply resonant antenna device 6A has the following arrangement.

That is, the multiply resonant antenna device 6A includes a monopole element 61 as the first antenna element, a parasitic element 62 as the second antenna element, and a folded monopole element 63 as the third antenna element.

The monopole element 61 includes an L-shaped conductive pattern having one end connected to the feed terminal 4 and the other end open. The length of the monopole element 61 is set to a ¼ of wavelength corresponding to a first resonant frequency f1.

The parasitic element 62 includes an L-shaped conductive pattern having one end connected to the ground terminal 5 and the other end open. The parasitic element 62 is placed at a position where it is located outside the monopole element 61 and can be current-coupled to the monopole element 61. The length of the parasitic element 62 is set to a ¼ of wavelength corresponding to a second resonant frequency f2, which is set to be higher than the first resonant frequency f1.

The folded monopole element 63 is formed from a conductive pattern having a design obtained by folding the element in a hairpin form at a position dividing the entire element into two portions, with one end of the element being connected to the feed terminal 4, and the other end being connected to the ground terminal 5. The formation position of the folded monopole element 63 is set between the formation position of the monopole element 61 and the ground pattern portion 1*b*. The length of the folded monopole element 63, that is, the electrical length from the feed terminal 4 to the ground terminal 5 through the folding position, is set to a ½ of wavelength corresponding to a third resonant frequency f3, which is set to be higher than the first and second resonant frequencies f1 and f2.

That is, the multiply resonant antenna device 6A according to the first embodiment is configured to make the first, second, and third resonant frequencies f1, f2, and f3 satisfy the following relation:

$$f3>f2>f1$$

With this arrangement, the folded monopole element 63 generates the third resonant frequency f3 which is the highest among the three resonant frequencies as targets. The effect of the parasitic element 62 suppresses the influence of parallel resonance occurring between the third resonant frequency generated by the folded monopole element 63 and the first resonant frequency f1, which is the lowest resonant frequency, generated by the monopole element 61. This makes it possible to expand the band of resonant frequencies from the first resonant frequency f1 to the third resonant frequency f3.

Figure 2:
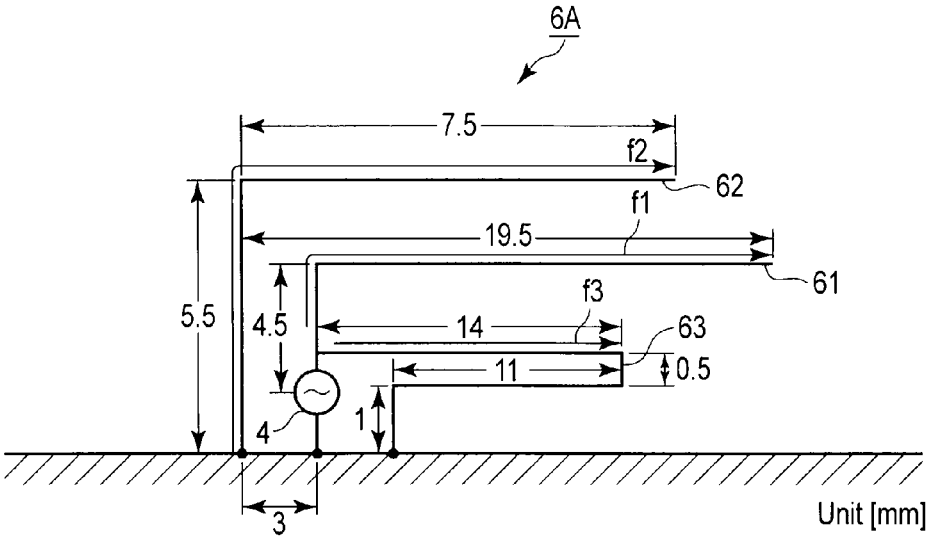
FIG. 2 is a view showing an example of the antenna device shown in FIG. 1.
Figure 3:
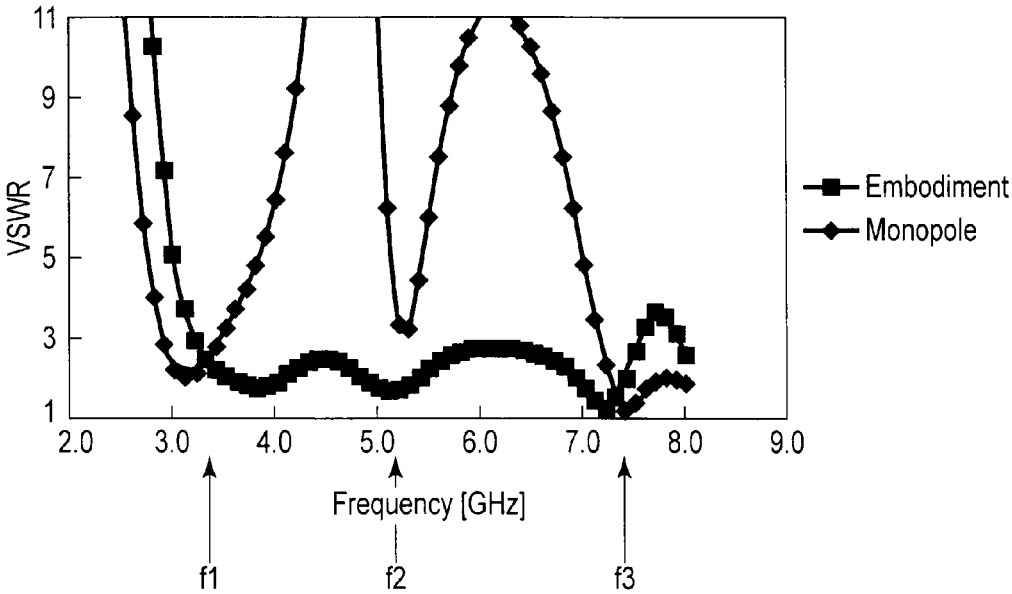
FIG. 3 is a graph showing VSWR frequency characteristics of the antenna device shown in FIG. 2 in comparison with a monopole antenna.

Assume that the element lengths and placement intervals of the monopole element 61, parasitic element 62, and folded monopole element 63 are set as shown in FIG. 2, and voltage standing wave ratio (VSWR) frequency characteristics are measured in this state. In this case, the characteristic plotted with symbol "■" in FIG. 3 is obtained. Note that the characteristic plotted with symbol "◆" in FIG. 3 indicates a VSWR frequency characteristic representing the resonant frequency generated by only the monopole element. As is obvious from this VSWR frequency characteristic, the multiply resonant antenna device 6A according to the first embodiment can continuously obtain a good VSWR frequency characteristic over a wide band of frequencies from 3.3 to 7.2 GHz. As a consequence, the single multiply resonant antenna device 6A can cover, for example, the typical band used by WiMAX.

Figure 4:
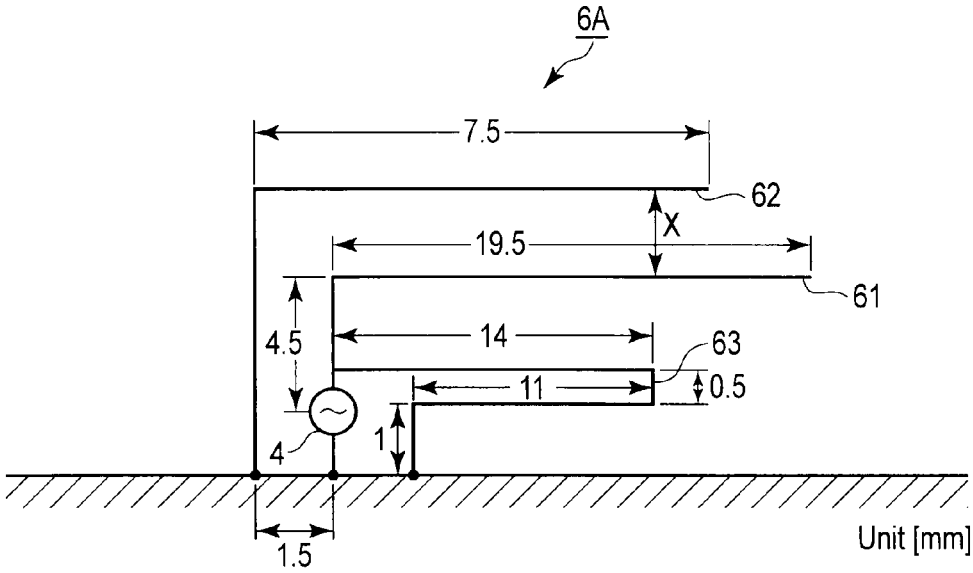
FIG. 4 is a view used to obtain the optimal interval between a monopole element and a parasitic element in the antenna device shown in FIG. 2.
Figure 5:
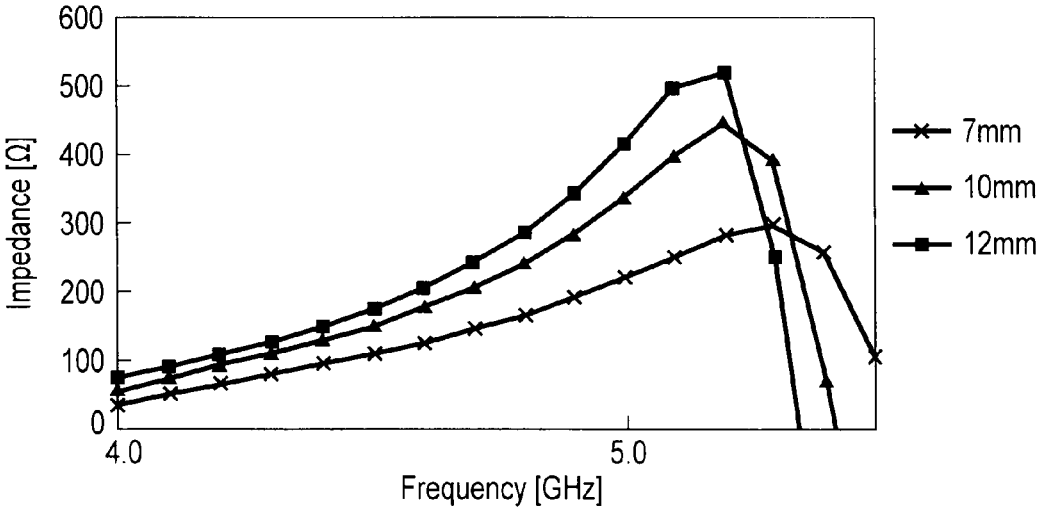
FIG. 5 is a graph showing the frequency characteristics of antenna impedances at the feed point of the antenna device shown in FIG. 4.

There is a proper range for an interval X between the monopole element 61 and the parasitic element 62. Assume that the element lengths and placement intervals of the monopole element 61, parasitic element 62, and folded monopole element 63 are set to those shown in FIG. 4. FIG. 5 shows the result obtained by measuring the frequency characteristics of antenna impedances at the feed terminal 4 when the interval X is changed to 7 mm, 10 mm, and 12 mm in this state.

As is obvious from this measurement result, as the interval X between the monopole element 61 and the parasitic element 62 decreases, the antenna impedance decreases. If the interval X is less than or equal to 10 mm, the parasitic element 62 can be expected to have the effect of suppressing parallel resonance. In other words, the interval X between the monopole element 61 and the parasitic element 62 is desirably set to a ⅙ wavelength or less in terms of the second resonant frequency f2.

Figure 6:
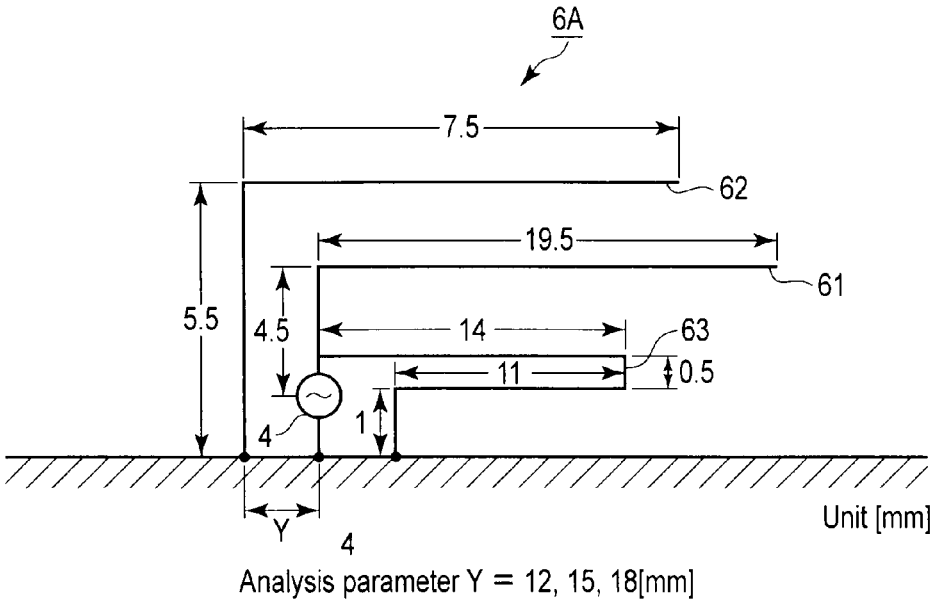
FIG. 6 is a view used to obtain the optimal interval between a feed point and a parasitic element in the antenna device shown in FIG. 2.
Figure 7:
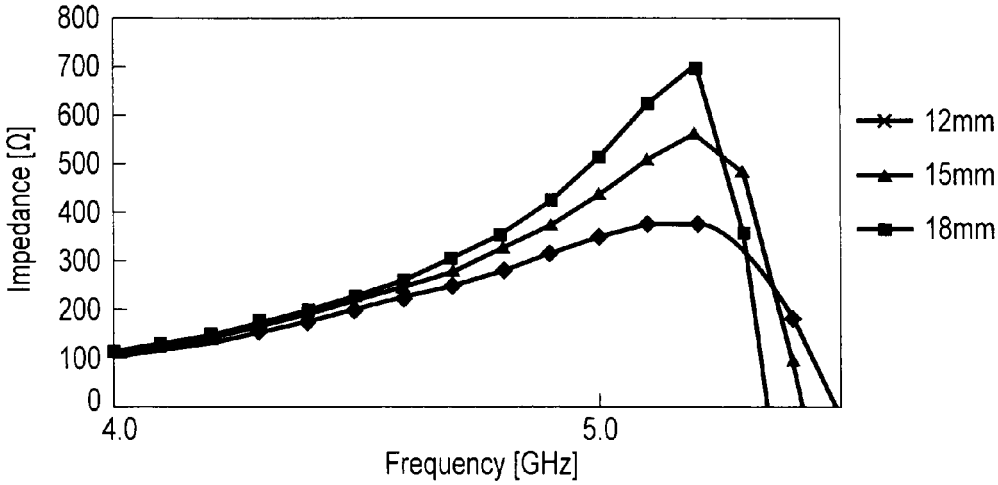
FIG. 7 is a graph showing the frequency characteristics of antenna impedances at the feed point of the antenna device shown in FIG. 6.

There is also a proper range for an interval Y between the ground point of the parasitic element 62 and the feed terminal of the monopole element 61. Assume that the element lengths and placement intervals of the monopole element 61, parasitic element 62, and folded monopole element 63 are set to those shown in FIG. 6. FIG. 7 shows the result obtained by measuring the frequency characteristics of antenna impedances at the feed terminal 4 when the interval Y is changed to 12, 15, and 18 mm.

As is obvious from this measurement result, as the interval Y between the ground point of the parasitic element 62 and the feed terminal of the monopole element 61 decreases, the antenna impedance decreases. If the interval Y is less than or equal to 18 mm, the parasitic element 62 can be expected to have the effect of suppressing parallel resonance. In other words, the interval Y between the ground point of the parasitic element 62 and the feed terminal of the monopole element 61 may be set to a ¼ wavelength or less in terms of the second resonant frequency f2.

As described in detail above, in the first embodiment, the parasitic element 62 is placed at a position ($X \leq \lambda/6$ and $Y \leq \lambda/4$) where it is located outside the monopole element 61 and can be current-coupled to the monopole element 61. In addition, the folded monopole element 63 is placed between the monopole element 61 and a ground pattern 1*b*, and the element lengths of the monopole element 61, parasitic element 62, the folded monopole element 63 are set to make the first, second, and third resonant frequencies f1, f2, and f3 respectively generated by the elements 61, 62, and 63 satisfy the relation of f3>f2>f1.

It is therefore possible to expand the band of resonant frequencies from the first resonant frequency f1 to the third resonant frequency f3. In addition, the folded monopole element 63 generates the highest resonant frequency f3, and all the elements 61, 62, and 63 are folded in the same direction. This makes it possible to reduce the overall installation area of the antenna device.

Second Embodiment

Figure 8:
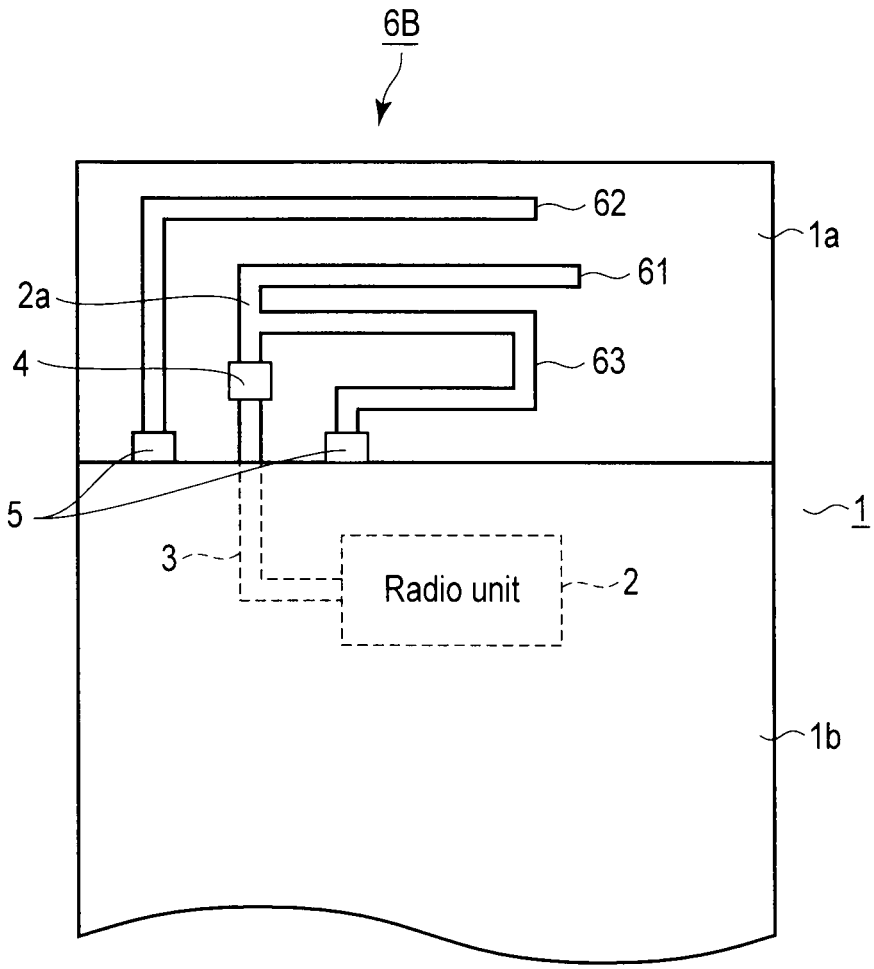
FIG. 8 is a view showing the arrangement of the main part of an electronic device including an antenna device according to the second embodiment.

FIG. 8 is a view showing the arrangement of the main part of an electronic device including a multiply resonant antenna device according to the second embodiment. The same reference numbers as in FIG. 8 denote the same parts in FIG. 1, and a detailed description of them will be omitted.

A multiply resonant antenna device 6B according to the second embodiment includes a monopole element 61 as the first antenna element, a parasitic element 62 as the second antenna element, and a folded monopole element 63 as the third antenna element as in the first embodiment.

The monopole element 61 includes an L-shaped conductive pattern having one end connected to a feed terminal 4 and the other end open. The parasitic element 62 includes an L-shaped conductive pattern having one end connected to a ground terminal 5 and the other end open. The parasitic element 62 is placed at a position where it is located outside the monopole element 61 and can be current-coupled to the monopole element 61. The folded monopole element 63 has a design obtained by folding the element in a hairpin form at a position dividing the entire element into two portions. One end of this element is connected to the feed terminal 4, and the other end is connected to the ground terminal 5. The folded monopole element 63 is formed between a ground pattern 1*b* and the formation position of the monopole element 61.

The length of the folded monopole element 63, that is, the electrical length from the feed terminal 4 to the ground terminal 5 through the folding position, is set to a ½ of wavelength corresponding to a third resonant frequency f3, which is set to be the highest among the three resonant frequencies as targets. The length of the monopole element 61 is set to a ¼ of wavelength corresponding to a first resonant frequency f1 lower than the third resonant frequency f3. The length of the parasitic element 62 is set to a ¼ of wavelength corresponding to a second resonant frequency f2 lower than the third and first resonant frequencies f3 and f1.

In the multiply resonant antenna device 6B according to the second embodiment, the first, second, and third resonant frequencies f1, f2, and f3 satisfy the following relation:

$$f3>f1>f2$$

With this arrangement, the folded monopole element 63 generates the third resonant frequency f3 which is the highest among the three resonant frequencies as targets. The parasitic element 62 generates the second resonant frequency f2 in a band lower than the first resonant frequency f1 generated by the monopole element 61.

Figure 9:
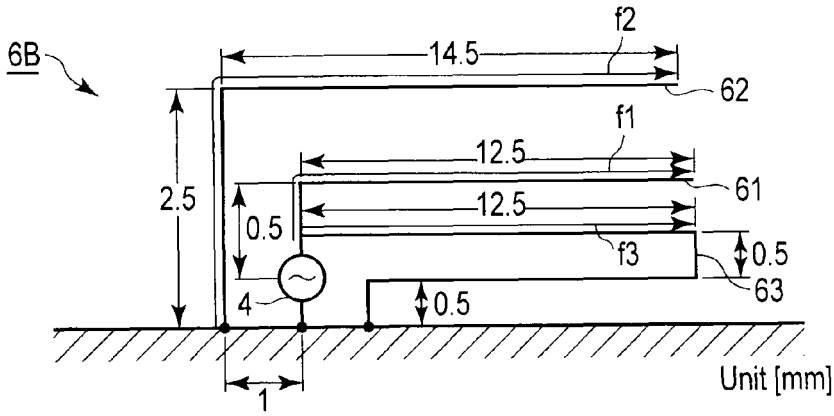
FIG. 9 is a view showing an example of the antenna device shown in FIG. 8.
Figure 10A:
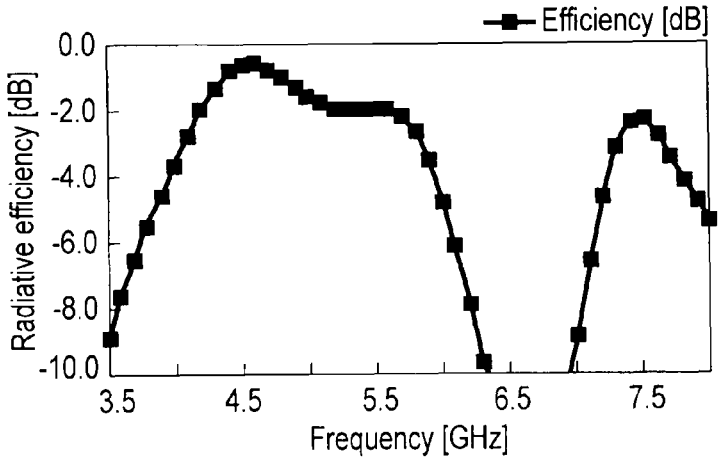
FIGS. 10A and 10B are graphs showing the radiative efficiency characteristics and VSWR frequency characteristics of the antenna device shown in FIG. 9.
Figure 10B:
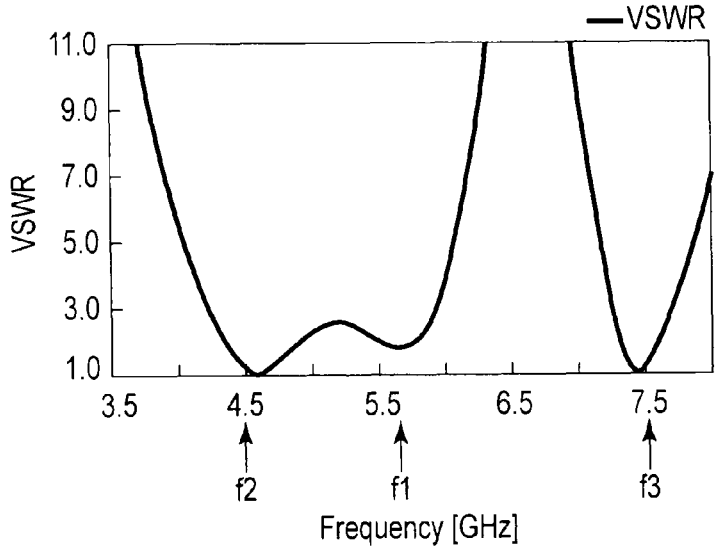

Assume that the element lengths and placement intervals of the monopole element 61, parasitic element 62, and folded monopole element 63 are set as shown in FIG. 9, and the frequency characteristics of radiative efficiency and VSWR frequency characteristics are measured in this state. FIGS. 10A and 10B show the obtained characteristics. As is obvious from these characteristics, the monopole element 61 and the folded monopole element 63 respectively generate resonant frequencies of 5.7 and 7.4 GHz, and the parasitic element 62 generates a resonant frequency at 4.5 GHz lower than the first resonant frequency f1 generated by the monopole element 61. Furthermore, owing to the relative positional relationship between the monopole element 61 and the parasitic element 62, it is possible to generate a continuous resonance band from the second resonant frequency f2 to the first resonant frequency f1.

Figure 11:
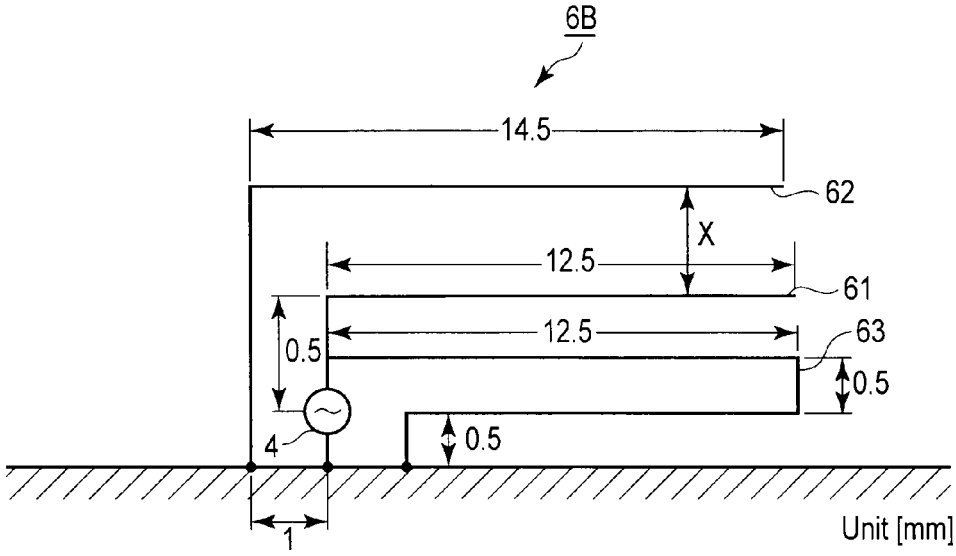
FIG. 11 is a view used to obtain the optimal interval between a monopole element and a parasitic element in the antenna device shown in FIG. 8.
Figure 12:
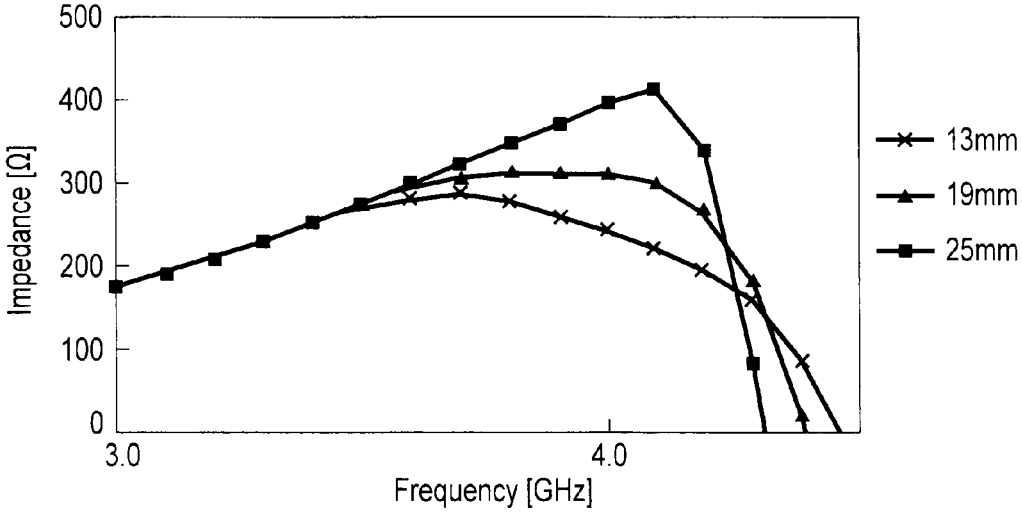
FIG. 12 is a graph showing the frequency characteristics of antenna impedances at the feed point of the antenna device shown in FIG. 11.

In order to make the parasitic element 62 effectively generate a resonant frequency, it is necessary to set a proper range for an interval X between the monopole element 61 and the parasitic element 62. Assume that the element lengths and placement intervals of the monopole element 61, parasitic element 62, and folded monopole element 63 are set to those shown in FIG. 11. FIG. 12 shows the result obtained by measuring the frequency characteristics of antenna impedances at the feed terminal 4 when the interval X is changed to 13 mm, 19 mm, and 25 mm in this state.

As is obvious from this measurement result, as the interval X between the monopole element 61 and the parasitic element 62 decreases, the antenna impedance decreases. If the interval X is less than or equal to 19 mm, the parasitic element 62 generates the second resonant frequency f2. In other words, the interval X between the monopole element 61 and the parasitic element 62 may be set to a ¼ wavelength or less in terms of the second resonant frequency f2.

Figure 13:
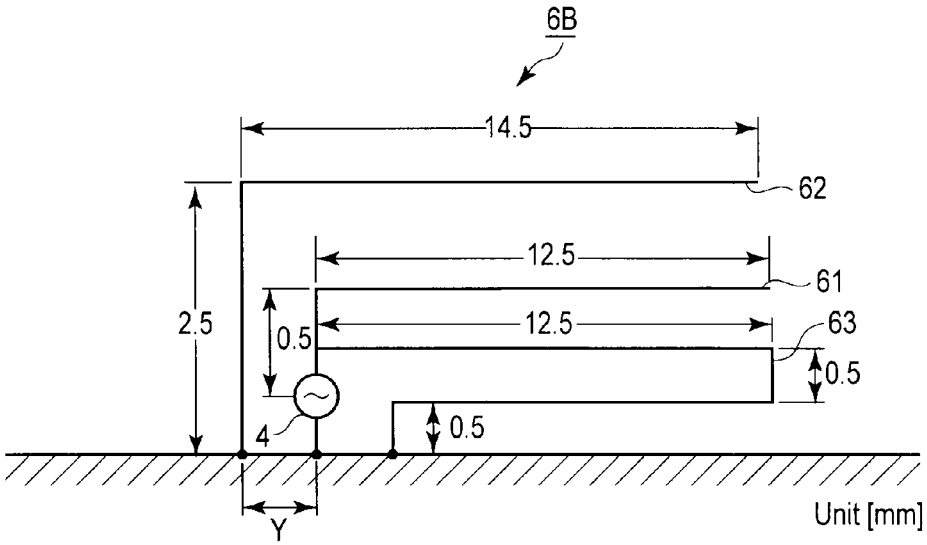
FIG. 13 is a view used to obtain the optimal interval between the feed point and the parasitic element in the antenna device shown in FIG. 8.
Figure 14:
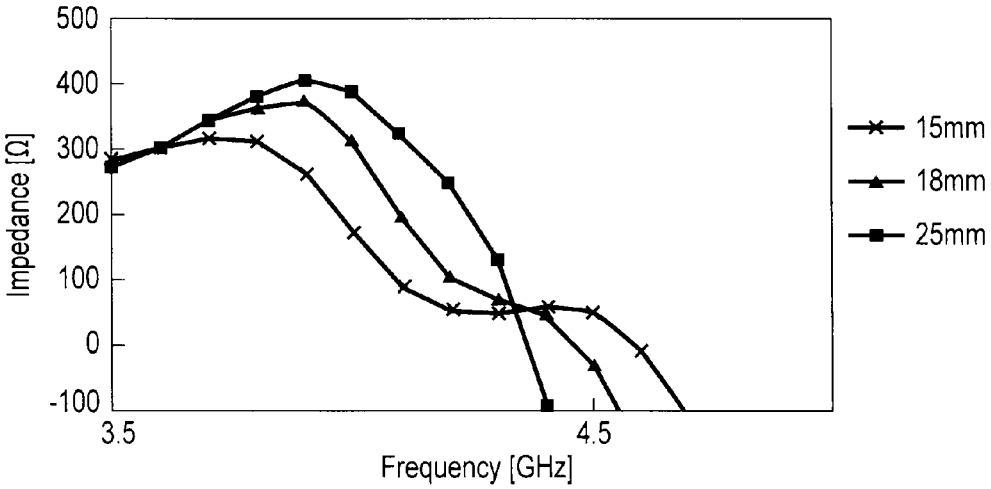
FIG. 14 is a graph showing the frequency characteristics of antenna impedances at the feed point of the antenna device shown in FIG. 13.

In order to make the parasitic element 62 effectively generate the second resonant frequency f2, it is necessary to set a proper range for an interval Y between the ground point of the parasitic element 62 and the feed terminal of the monopole element 61. Assume that the element lengths and placement intervals of the monopole element 61, parasitic element 62, and folded monopole element 63 are set to those shown in FIG. 13. FIG. 14 shows the result obtained by measuring the frequency characteristics of antenna impedances at the feed terminal 4 when the interval Y is changed to 15 mm, 18 mm, and 25 mm in this state.

As is obvious from this measurement result, the effect of the parasitic element 62 can be expected up to Y=15 mm, which is the interval between the ground point of the parasitic element 62 and the feed terminal of the monopole element 61. In other words, the interval Y between the ground point of the parasitic element 62 and the feed terminal of the monopole element 61 may be set to a ¼ wavelength or less in terms of the second resonant frequency f2.

As described in detail above, in the second embodiment, the parasitic element 62 is placed at a position ($X \leq \lambda/4$ and $Y \leq \lambda/4$) where it is located outside the monopole element 61 and can be current-coupled to the monopole element 61. In addition, the folded monopole element 63 is placed between the monopole element 61 and a ground pattern 1*b*, and element lengths of the monopole element 61, parasitic element 62, and folded monopole element 63 are set to make the first, second, and third resonant frequencies f1, f2, and f3 respectively generated by the elements 61, 62, and 63 satisfy the relation of f3>f1>f2.

The folded monopole element 63 therefore generates the third resonant frequency f3 which is the highest among the three resonant frequencies as targets. The parasitic element 62 generates the second resonant frequency f2 in a band lower than the first resonant frequency f1 generated by the monopole element 61. It is therefore possible to make the band from the second resonant frequency f2 to the first resonant frequency f1 become a continuous resonance band. In addition, the folded monopole element 63 generates the highest resonant frequency f3, and all the elements 61, 62, and 63 are folded in the same direction. This makes it possible to reduce the overall installation area of the antenna device.

Third Embodiment

Figure 15:
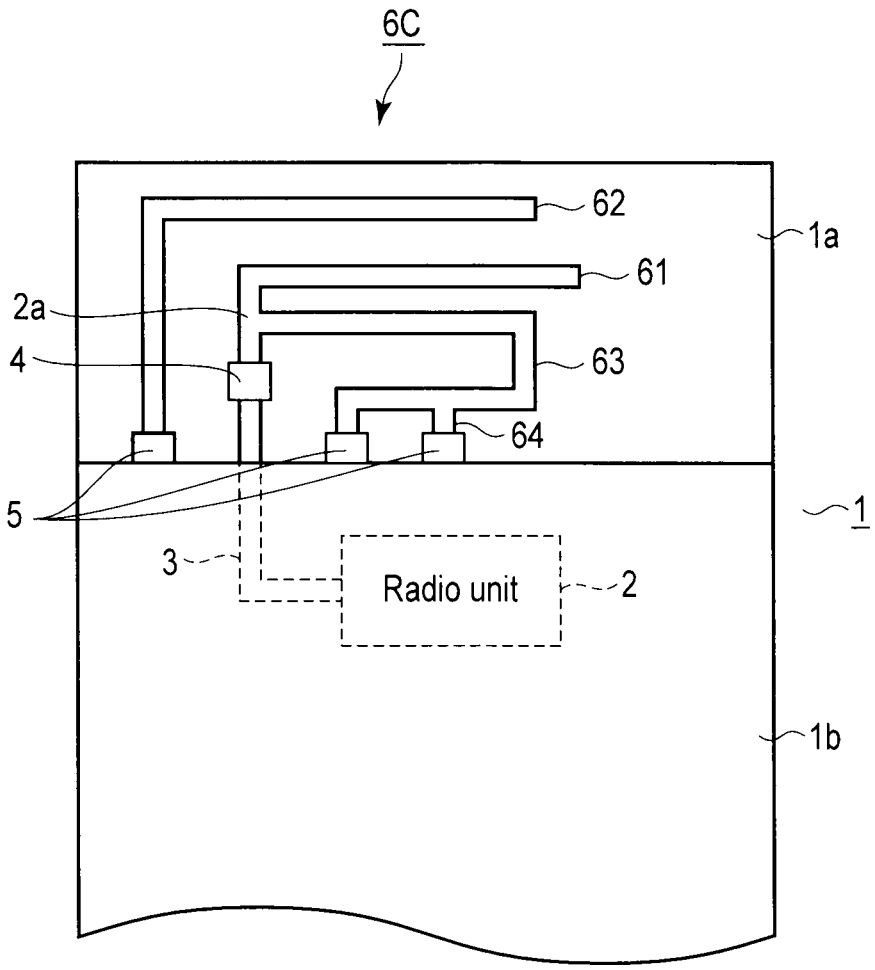
FIG. 15 is a view showing the arrangement of the main part of an electronic device including an antenna device according to the third embodiment.

FIG. 15 is a view showing the arrangement of the main part of an electronic device including a multiply resonant antenna device according to the third embodiment. The same reference numbers as in FIG. 15 denote the same parts in FIGS. 1 and 8, and a detailed description of them will be omitted.

A multiply resonant antenna device 6C according to the third embodiment includes a stub 64 in addition to a monopole element 61 as the first antenna element, a parasitic element 62 as the second antenna element, and a folded monopole element 63 as the third antenna element. The stub 64 is connected between a ground terminal 5 and an arbitrary position on the backward path of the folded monopole element 63 which extends from the folding position to the ground terminal 5.

Note that as in the second embodiment, the element lengths of the monopole element 61, parasitic element 62, the folded monopole element 63 are set to make first, second, and third resonant frequencies f1, f2, and f3 respectively generated by the elements 61, 62, and 63 satisfy the following relation:

f3>f1>f2

With this arrangement, in the folded monopole element 63, currents respectively flow in a path extending from a feed terminal 4 to the ground terminal 5 through the folding position and a path extending from the feed terminal 4 to the ground terminal 5 through the folding position and the stub 64. These paths respectively generate resonant frequencies.

Figure 16:
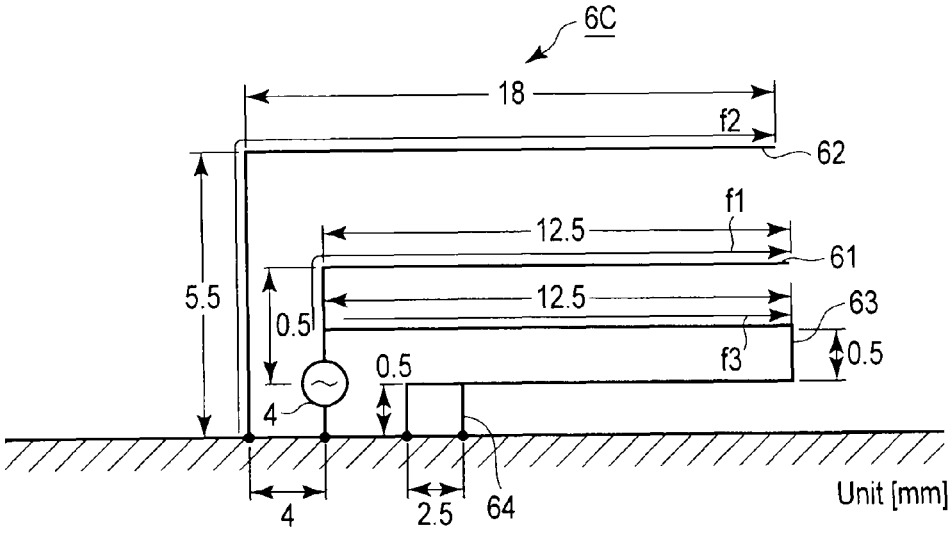
FIG. 16 is a view showing an example of the antenna device shown in FIG. 15.
Figure 17A:
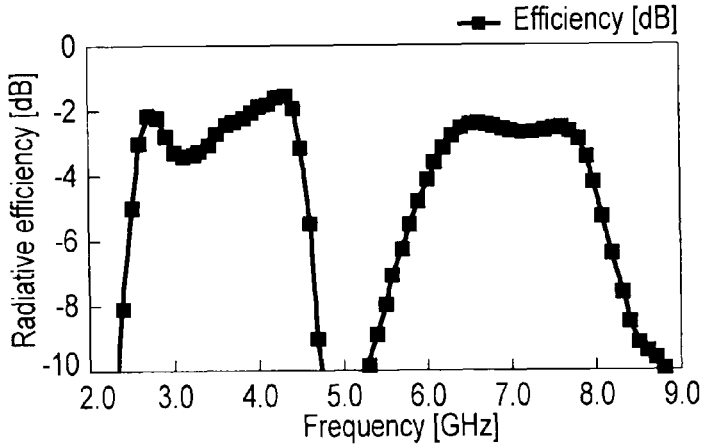
FIGS. 17A and 17B are graphs showing the radiative efficiency characteristics and VSWR frequency characteristics of the antenna device shown in FIG. 16.
Figure 17B:
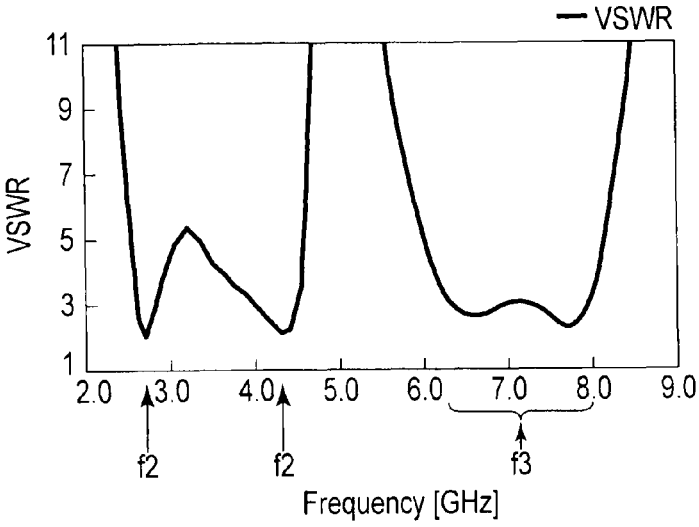
Figure 18:
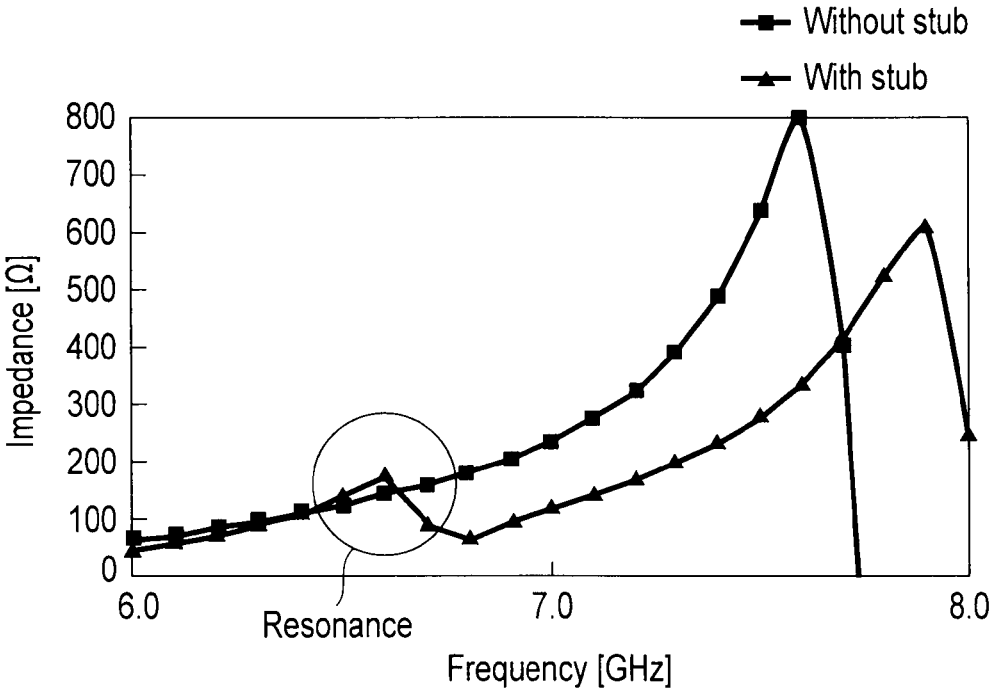
FIG. 18 is a graph showing the frequency characteristics of antenna impedances at the feed point in the antenna device shown in FIG. 16 in comparison with a device without any stub.

Assume that the element lengths and placement intervals of the monopole element 61, parasitic element 62, folded monopole element 63, and stub 64 are set as shown in FIG. 16, and the frequency characteristics of radiative efficiency and VSWR frequency characteristics are measured in this state. FIGS. 17A and 17B show the obtained characteristics. FIG. 18 shows the result obtained by measuring the frequency characteristics of antenna impedances at the feed terminal 4 with and without the stub 64 under the same conditions.

As is obvious from these characteristics, the monopole element 61 and folded monopole element 63 respectively generate resonant frequencies at 4.5 and 6.5 GHz. The parasitic element 62 generates a resonant frequency at 2.5 GHz lower than the first resonant frequency f1 generated by the monopole element 61. In addition, the stub 64 generates a resonant frequency at 7.7 GHz higher than the third resonant frequency f3. In addition, properly setting the installation position of the stub 64 can generate a continuous resonance band from 6.5 GHz, which is the third resonant frequency f3, to 7.7 GHz described above.

As described in detail above, according to the third embodiment, it is possible to increase the number of resonant frequencies and expand the third resonant frequency band generated by the folded monopole element 63 by connecting the stub 64 between the ground terminal 5 and an arbitrary position on the backward path extending from the folding position of the folded monopole element 63 to the ground terminal 5.

Other Embodiments

Example 1

Figure 19:
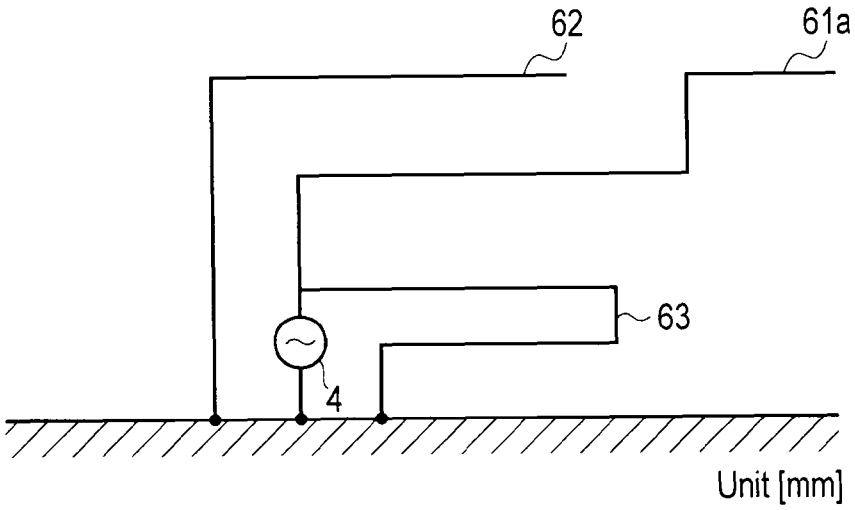
FIG. 19 is a view showing Example 1 of an antenna device according to another embodiment.

A multiply resonant antenna device according to Example 1 of another embodiment includes a monopole element 61*a* which is placed with its second end portion being folded in a stepped design, as shown in FIG. 19. This arrangement allows a monopole element to be mounted on a printed circuit board even if the element cannot be linearly placed because of the lack of a sufficient vacant space on the board.

Example 2

Figure 20:
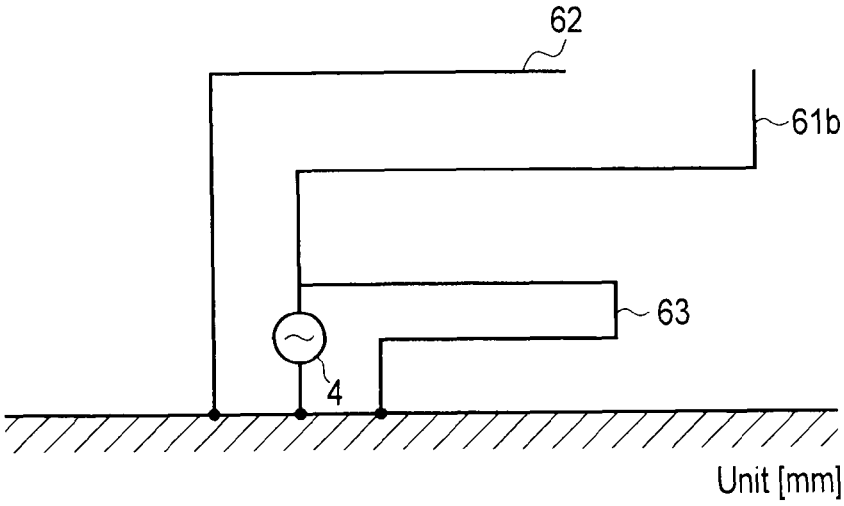
FIG. 20 is a view showing Example 2 of an antenna device according to still another embodiment.

A multiply resonant antenna device according to Example 2 of still another embodiment includes a monopole element 61*b* which is placed with its second end portion being folded in an L-shape, as shown in FIG. 20. This arrangement can reduce the installation space of the antenna device.

Example 3

A multiply resonant antenna device according to Example 3 of still another embodiment includes a monopole element

Figure 21:
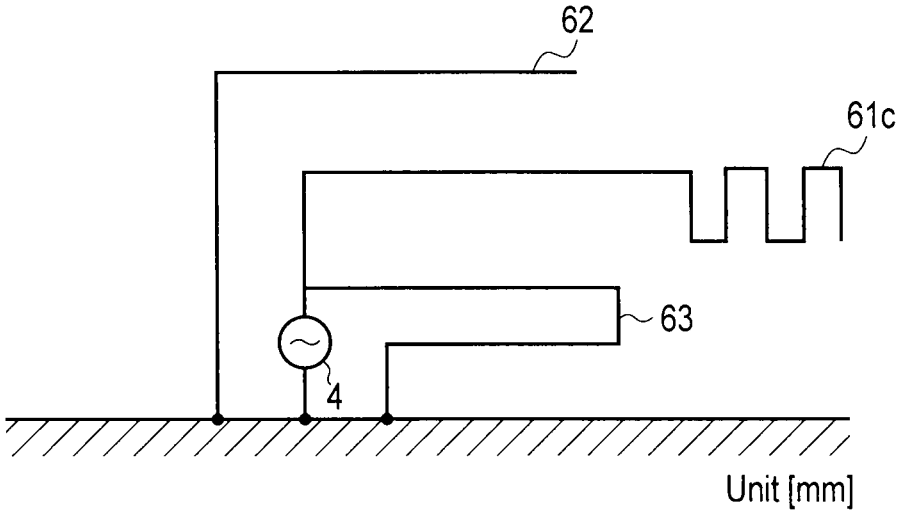
FIG. 21 is a view showing Example 3 of an antenna device according to still another embodiment.

61*c* which is placed with its second end portion being folded in a meandering design, as shown in FIG. 21. This arrangement allows the antenna device to be placed in a space with a small mounting area even if the element length of the monopole element is long.

Example 4

Figure 22:
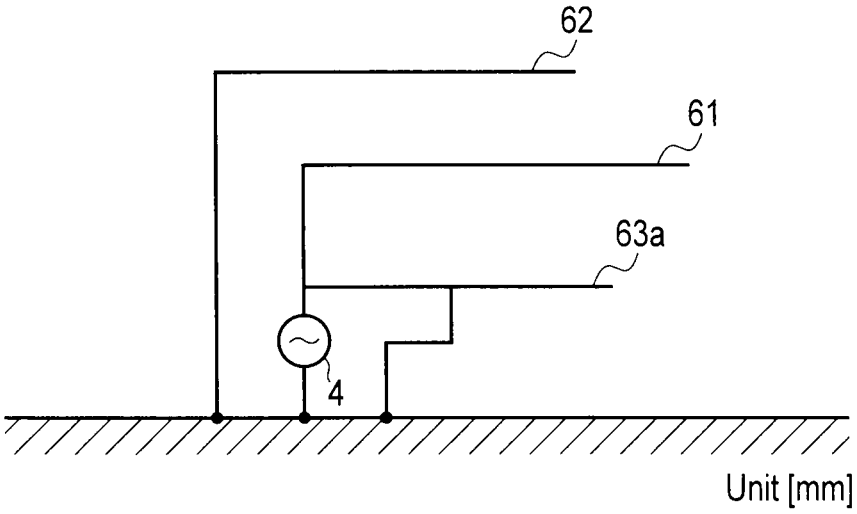
FIG. 22 is a view showing Example 4 of an antenna device according to still another embodiment.

A multiply resonant antenna device according to Example 4 of still another embodiment includes a folded monopole element 63*a* whose second end is made open, as shown in FIG. 22. This arrangement can reduce the installation space of the folded monopole element.

Example 5

Figure 23:
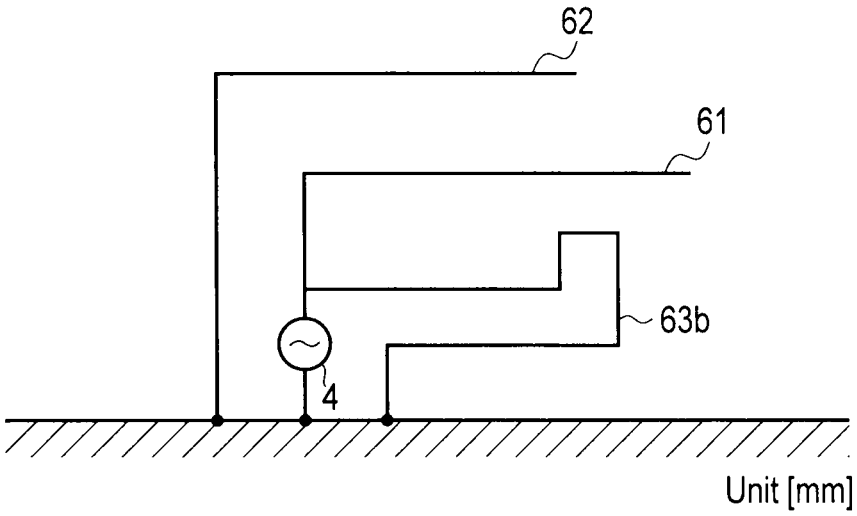
FIG. 23 is a view showing Example 5 of an antenna device according to still another embodiment.

A multiply resonant antenna device according to Example 5 of still another embodiment includes a folded monopole element 63*b* which is placed with its second end portion being folded, as shown in FIG. 23. This arrangement allows the antenna device to be placed in a space with a small mounting area even if the element length of the folded monopole element is long.

Example 6

Figure 24:
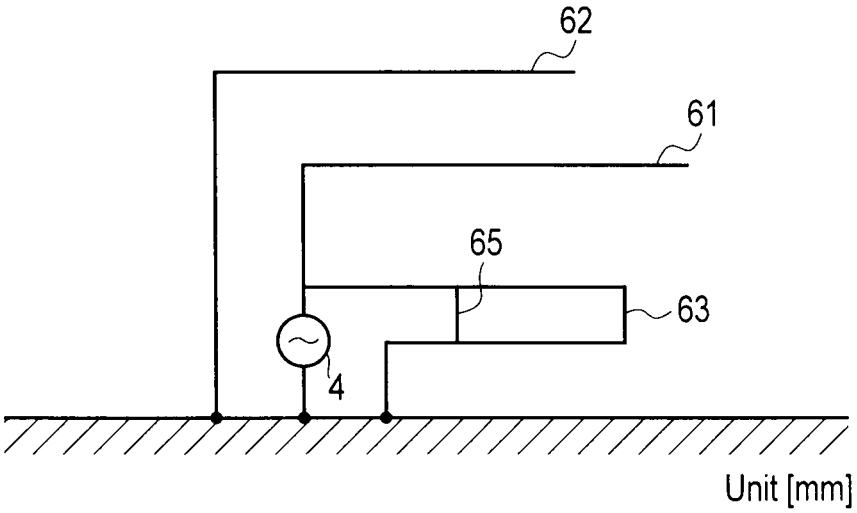
FIG. 24 is a view showing Example 6 of an antenna device according to still another embodiment.

A multiply resonant antenna device according to Example 6 of still another embodiment includes a stub 65 provided between the forward portion of a folded monopole element 63 which extends from a feed terminal 4 to the folding position and the backward portion of the folded monopole element 63 which extends from the folding position to a ground terminal, as shown in FIG. 24. This arrangement can expand the resonant frequency band of the folded monopole element 63.

Example 7

Figure 25:
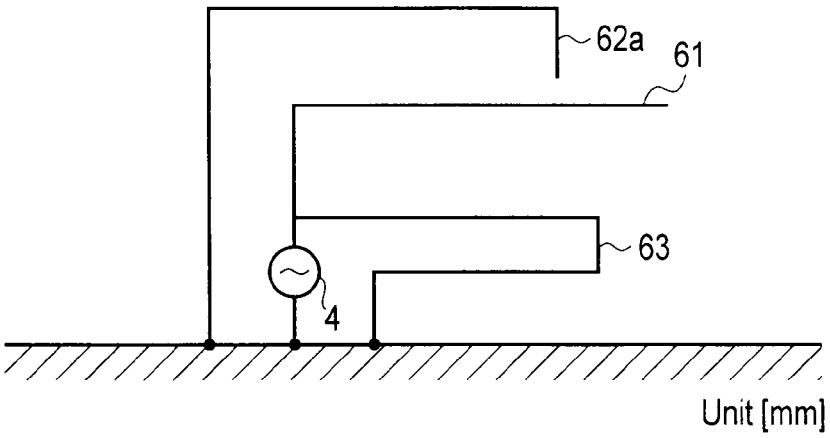
FIG. 25 is a view showing Example 7 of an antenna device according to still another embodiment.

A multiply resonant antenna device according to Example 7 of still another embodiment includes a parasitic element 62*a* which is placed with its second end portion being folded, as shown in FIG. 25. This arrangement can reduce the installation space of the parasitic element.

Example 8

Figure 26:
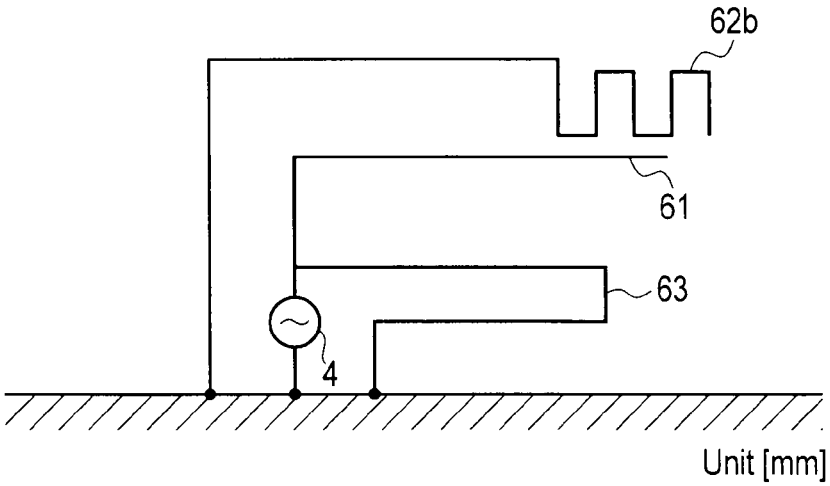
FIG. 26 is a view showing Example 8 of an antenna device according to still another embodiment.

A multiply resonant antenna device according to Example 8 of still another embodiment includes a parasitic element 62*b* which is placed with its second end portion being folded in a meandering design, as shown in FIG. 26. This arrangement allows the antenna device to be placed in a space with a small mounting area even if the element length of the parasitic element is long.

Example 9

Figure 27:
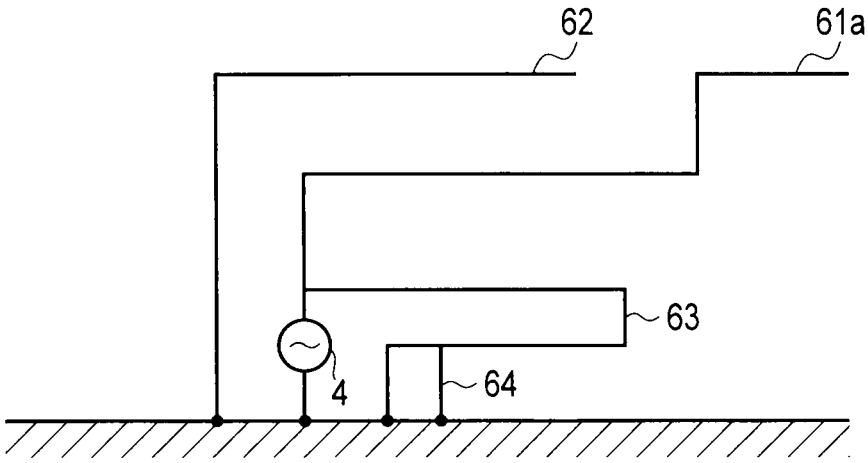
FIG. 27 is a view showing Example 9 of an antenna device according to still another embodiment.

A multiply resonant antenna device according to Example 9 of still another embodiment includes a monopole element 61*a* which is placed with its second end portion being folded in a stepped design, and a stub 64 with a linear pattern provided on a folded monopole element 63, as shown in FIG. 27.

Example 10

Figure 28:
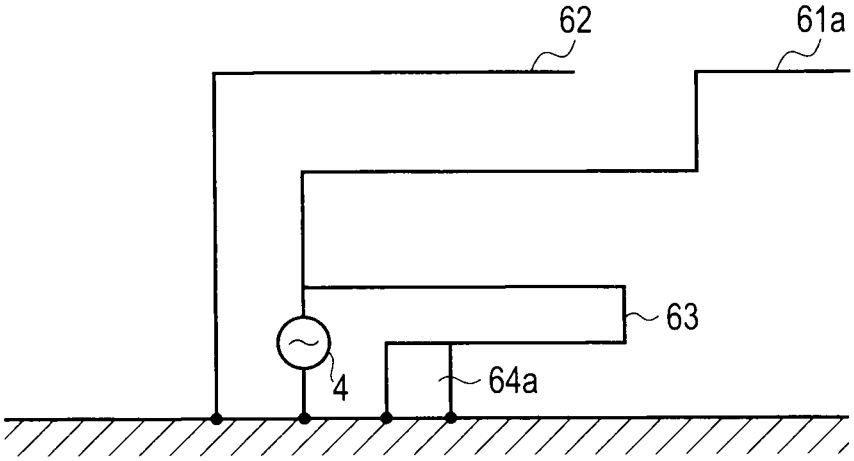
FIG. 28 is a view showing Example 10 of an antenna device according to still another embodiment.

A multiply resonant antenna device according to Example 10 of still another embodiment includes a monopole element 61*a* which is placed with its second end portion being folded in a stepped design, and a stub 64*a* with a plate-like pattern provided on a folded monopole element 63, as shown in FIG. 28.

Example 11

Figure 29:
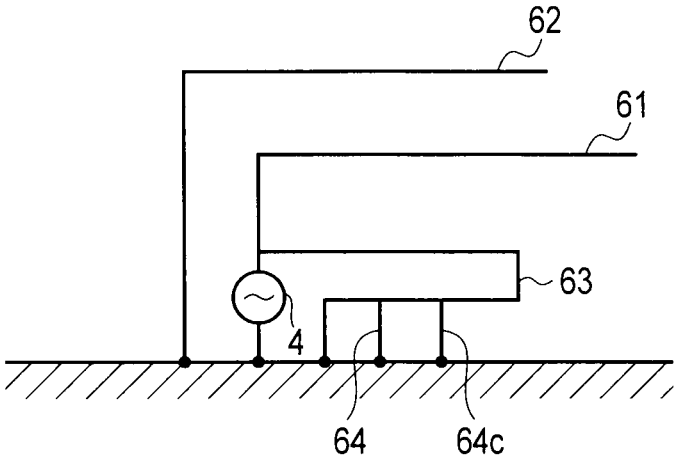
FIG. 29 is a view showing Example 11 of an antenna device according to still another embodiment.

A multiply resonant antenna device according to Example 11 of still another embodiment includes a plurality of stubs 64 and 64*c* provided on a folded monopole element 63, as shown in FIG. 29. This arrangement can further expand the resonant frequency band of the folded monopole element 63.

Example 12

Figure 30:
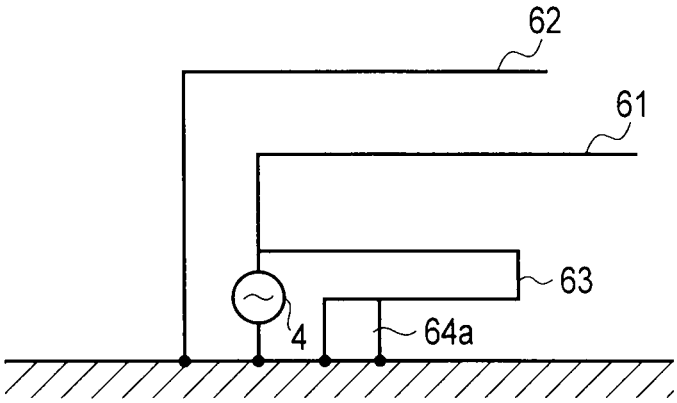
FIG. 30 is a view showing Example 12 of an antenna device according to still another embodiment.

A multiply resonant antenna device according to Example 12 of still another embodiment includes a stub 64*a* with a plate-like pattern having a predetermined width provided on a folded monopole element 63, as shown in FIG. 30. This arrangement can further expand the resonant frequency band of the folded monopole element 63.

Example 13

Figure 31:
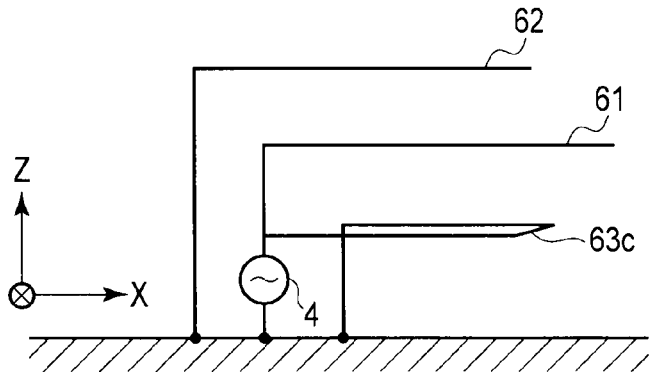
FIG. 31 is a view showing Example 13 of an antenna device according to still another embodiment.

A multiply resonant antenna device according to Example 13 of still another embodiment includes a folded monopole element 63*c* which is placed while being folded in the Y direction in FIG. 31, for example, from the upper surface side to the lower surface side of a printed circuit board 1, as shown in FIG. 31. This arrangement allows the folded monopole element to be placed on the printed circuit board 1 even if there is no vacant space on the upper surface of the printed circuit board 1.

Example 14

Figure 32A:
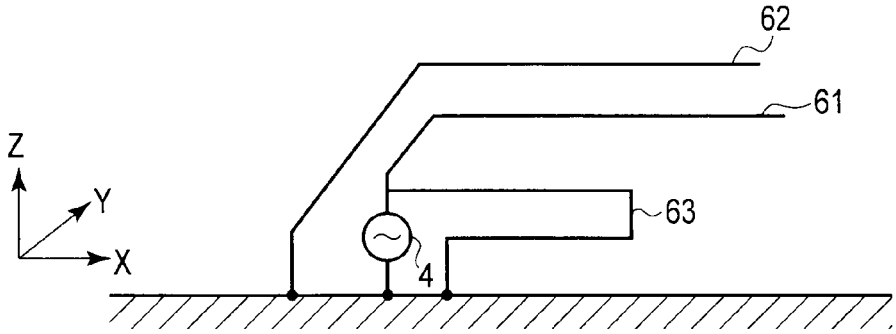
FIGS. 32A and 32B are views showing Example 14 of an antenna device according to still another embodiment.
Figure 32B:
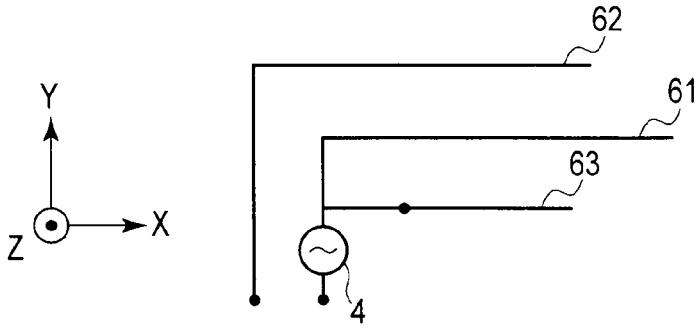

A multiply resonant antenna device according to Example 14 of still another embodiment includes a monopole element 61 and a parasitic element 62 which are placed while being folded in the X-Y plane in FIGS. 32A and 32B, and a folded monopole element 63 which is placed while being folded in the Z direction in FIGS. 32A and 32B, as shown in the side view of FIG. 32A and the plan view of FIG. 32B. This arrangement allows the elements 61, 62, and 63 of the antenna device to be three-dimensionally installed in, for example, a corner portion of the housing, thereby allowing the antenna device to be installed in a dead space in the housing.

Example 15

Figure 33A:
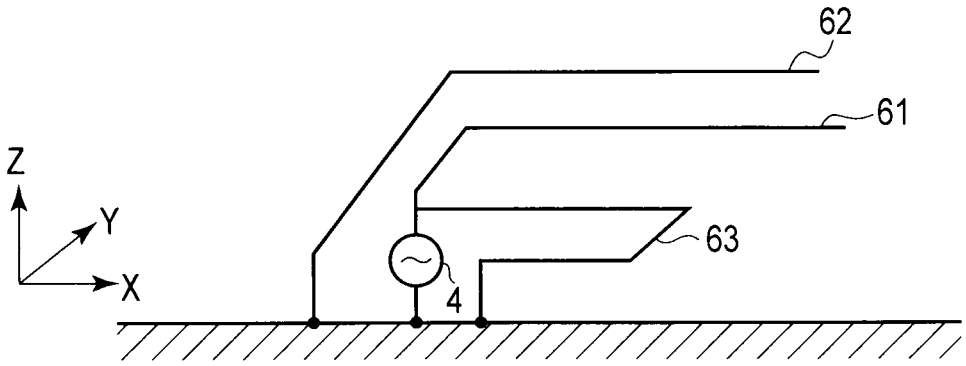
FIGS. 33A and 33B are views showing Example 15 of an antenna device according to still another embodiment.
Figure 33B:
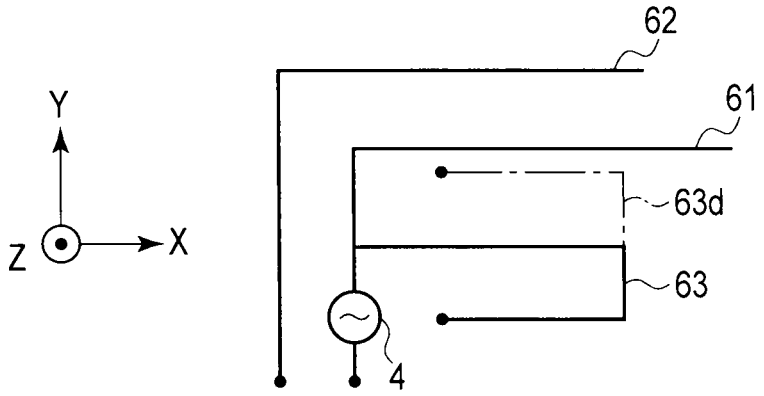

A multiply resonant antenna device according to Example 15 of still another embodiment includes a monopole element 61, a parasitic element 62, and a folded monopole element 63 which are placed while being folded in the X-Y plane in FIGS. 33A and 33B, as shown in the side view of FIG. 33A and the plan view of the FIG. 33B. This arrangement allows, for example, the elements 61, 62, and 63 of the antenna device to be three-dimensionally placed, thereby allowing the antenna device to be placed in a dead space in the housing. Folding a folded monopole element 63*d* to the monopole element 61 side, in particular, can further reduce the installation space of the antenna device in the Y direction.

Example 16

Figure 34:
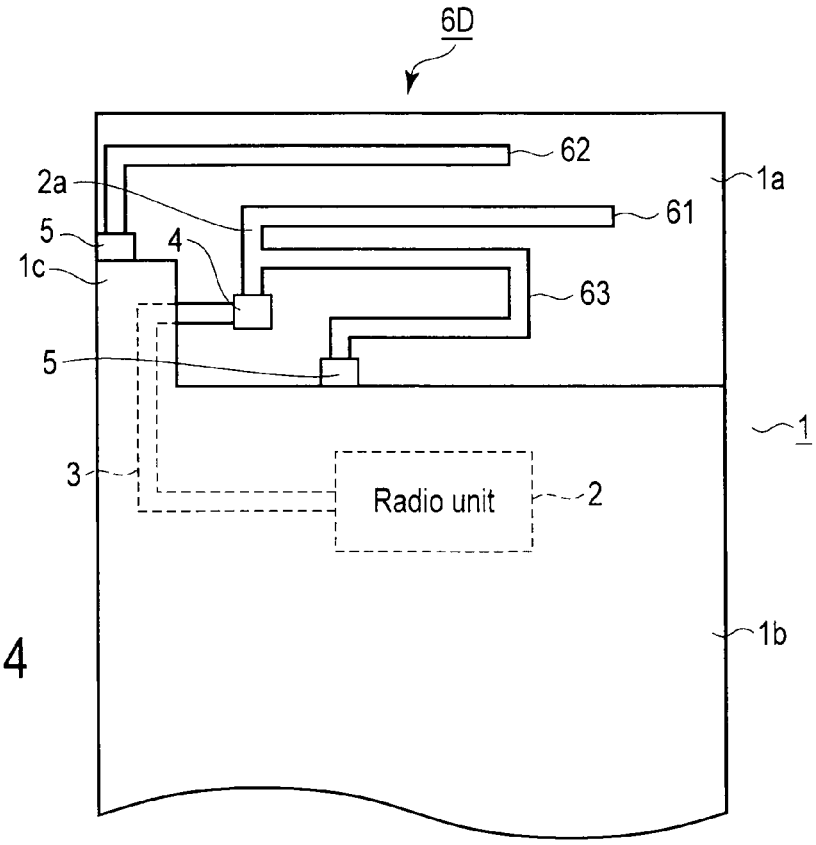
FIG. 34 is a view showing Example 16 of an antenna device according to still another embodiment.

FIG. 34 is a view showing the arrangement of the main part of an electronic device including an antenna device according to Example 16 of still another embodiment. This antenna device is configured such that part of a ground pattern 1*b* of a printed circuit board 1 is extended, and the proximal end portion of a parasitic element 62 is placed on an extended portion 1*c* through a ground terminal 5. This arrangement allows the parasitic element 62 to be placed outside a monopole element 61 even if the element length of the parasitic element 62 is short.

Example 17

Figure 35:
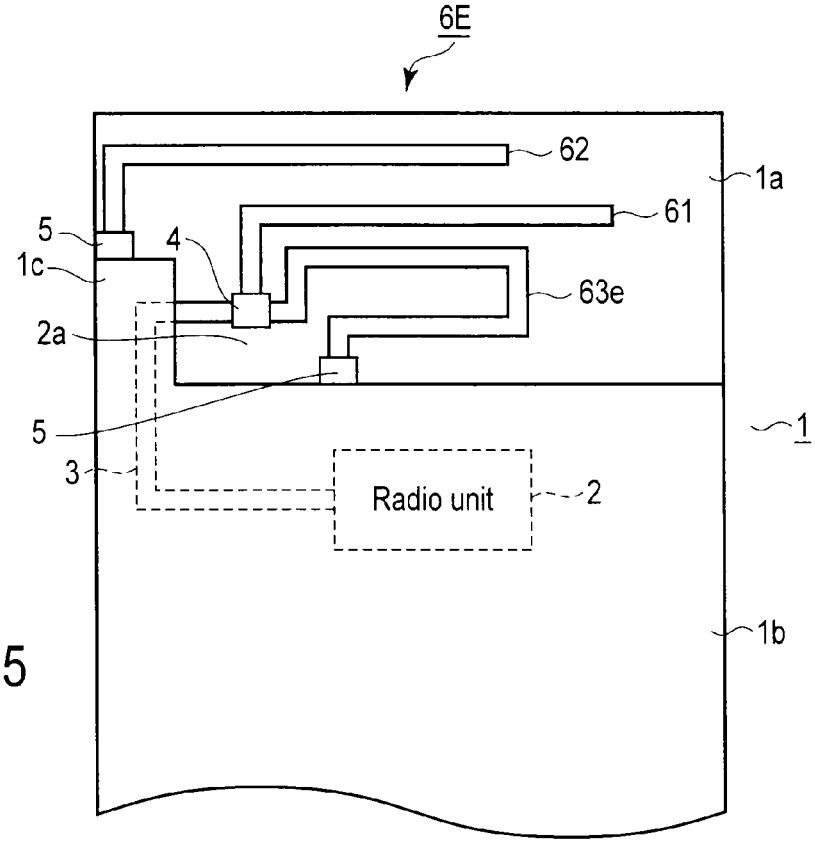
FIG. 35 is a view showing Example 17 of an antenna device according to still another embodiment.

FIG. 35 is a view showing the arrangement of the main part of an electronic device including an antenna device according to Example 17 of still another embodiment. This antenna device is an improvement of the antenna device shown in FIG. 34. That is, the forward portion of a folded monopole element 63*e* which extends from a feed terminal 4 to the folding position is folded in a stepped design. This arrangement can decrease the resonant frequency generated by the folded monopole element 63*e* as compared with the arrangement shown in FIG. 34.

Example 18

In the first embodiment, the parasitic element 62 is placed while being folded in the same direction as the folding direction of the monopole element 61. However, the parasitic element 62 may be placed while being folded in a direction opposite to the folding direction of the monopole element 61. This arrangement can reduce the space (profile) in the height direction of the antenna device, although the installation space of the antenna device in the widthwise direction increases.

In addition, the embodiments can be executed with various modifications associated with the designs, installation positions, and sizes of monopole elements, parasitic elements, and folded monopole elements, the types and arrangements of electronic devices, and the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A multiply resonant antenna device comprising:

a first antenna element formed from a monopole element which is bent into L-shape to have a first portion extending from a first end connected to a feed point to a first bending portion in a first direction, and a second portion extending, in a second direction, from the first bending portion to a second end open, and which has an element length set to substantially a ¼ of wavelength corresponding to a first resonant frequency;

a second antenna element which is formed from a parasitic element bent into a L-shape to have a third portion extending from a third end connected to a ground point to a second bending portion in the first direction, and a fourth portion extending, in the second direction, from the second bending portion to a fourth end open, wherein the second antenna element is so placed in such a manner that the parasitic element is configured to be current-coupled to the first antenna element, and the parasitic element has an element length set to substantially a ¼ of wavelength corresponding to a second resonant frequency; and a third antenna element which is formed from a folded monopole element bent into a hairpin shape to have fifth and sixth portions folded back at a folded portion, the fifth portion extending from a fifth end connected to the feed point to the folded portion in the second direction, the sixth portion extending from the folded portion in the second direction and being bent to a sixth end connected to the ground point, wherein the fourth open end and the folded portion is so positioned as to be closely aligned in respect to the second direction, and the second end is more extended from the fourth open end and the folded portion in respect to the second direction, the folded monopole element is so placed in such a manner that the parasitic element is configured to be current-coupled to the folded monopole element, the folded monopole element has an electrical length from the feed point to the ground point through a folding end, which is set to substantially a ½ of wavelength corresponding to a third resonant frequency, and is set to be higher than the first resonant frequency and the second resonant frequency.

2. The device of claim 1, wherein the first antenna element, the second antenna element, and the third antenna element are folded at midway positions in the same direction.

3. The device of claim 1, wherein the second antenna element has a length set to substantially a ¼ of wavelength corresponding to the second resonant frequency, which is set to be lower than the third resonant frequency and higher than the first resonant frequency.

4. The device of claim 3, wherein the first antenna element and the second antenna element are placed such that a placement interval between the elements becomes not more than a ⅙ of wavelength corresponding to the second resonant frequency.

5. The device of claim 3, wherein the second antenna element is placed such that a distance from the feed point of the first antenna element to the ground point of the second antenna element becomes not more than a ¼ of wavelength corresponding to the second resonant frequency.

6. The device of claim 1, wherein the first antenna element has a length set to substantially a ¼ of wavelength corresponding to the first resonant frequency, which is set to be lower than the third resonant frequency and higher than the second resonant frequency.

7. The device of claim 6, wherein the first antenna element and the second antenna element are placed such that a placement interval between the elements becomes not more than a ¼ of wavelength corresponding to the second resonant frequency.

8. The device of claim 6, wherein the second antenna element is placed such that a distance from the feed point of the first antenna element to the ground point of the second antenna element becomes not more than a ¼ of wavelength corresponding to the second resonant frequency.

9. The device of claim 1, further comprising:

a stub which is provided between the ground point and a folding end of the third antenna element which extends from the folding end to the ground point of the third antenna element.

10. An electronic device comprising:

a radio unit configured to transmit and receive a radio signal; and a multiply resonant antenna device connected to the radio unit via a feed point and a ground point, the multiply resonant antenna device including:

a first antenna element formed from a monopole element which is bent into L-shape to have a first portion extending from a first end connected to a feed point to a first bending portion in a first direction, and a second portion extending, in a second direction, from the first bending portion to a second end open, and which has an element length set to substantially a ¼ of wavelength corresponding to a first resonant frequency, a second antenna element which is formed from a parasitic element bent into a L-shape to have a third portion extending from a third end connected to a ground point to a second bending portion in the first direction, and a fourth portion extending, in the second direction, from the second bending portion to a fourth end open, wherein the second antenna element is so placed in such a manner that the parasitic element is configured to be current-coupled to the first antenna element, and the parasitic element has an element length set to substantially a ¼ of wavelength corresponding to a second resonant frequency, and a third antenna element which is formed from a folded monopole element bent into a hairpin shape to have fifth and sixth portions folded back at a folded portion, the fifth portion extending from a fifth end connected to the feed point to the folded portion in the second direction, the sixth portion extending from the folded portion in the second direction and being bent to a sixth end connected to the ground point, wherein the fourth open end and the folded portion is so positioned as to be closely aligned in respect to the second direction, and the second end is more extended from the fourth open end and the folded portion in respect to the second direction, the folded monopole element is so placed in such a manner that the parasitic element is configured to be current-coupled to the folded monopole element, the folded monopole element has an electrical length from the feed point to the ground point through a folding end, which is set to substantially a ½ of wavelength corresponding to a third resonant frequency, and is set to be higher than the first resonant frequency and the second resonant frequency.

11. The device of claim 10, wherein the first antenna element, the second antenna element, and the third antenna element are folded at midway positions in the same direction.

12. The device of claim 10, wherein the second antenna element has a length set to substantially a ¼ of wavelength corresponding to the second resonant frequency, which is set to be lower than the third resonant frequency and higher than the first resonant frequency.

13. The device of claim 12, wherein the first antenna element and the second antenna element are placed such that a placement interval between the elements becomes not more than a ⅙ of wavelength corresponding to the second resonant frequency.

14. The device of claim 12, wherein the second antenna element is placed such that a distance from the feed point of the first antenna element to the ground point of the second antenna element becomes not more than a ¼ of wavelength corresponding to the second resonant frequency.

15. The device of claim 10, wherein the first antenna element has a length set to substantially a ¼ of wavelength corresponding to the first resonant frequency, which is set to be lower than the third resonant frequency and higher than the second resonant frequency.

16. The device of claim 15, wherein the first antenna element and the second antenna element are placed such that a placement interval between the elements becomes not more than a ¼ of wavelength corresponding to the second resonant frequency.

17. The device of claim 15, wherein the second antenna element is placed such that a distance from the feed point of the first antenna element to the ground point of the second antenna element becomes not more than a ¼ of wavelength corresponding to the second resonant frequency.

18. The device of claim 10, further comprising:

a stub which is provided between the ground point and the folding end of the third antenna element which extends from the folding end to the ground point of the third antenna element.

* * * * *

UNITED STATES PATENT AND TRADEMARK OFFICE

CERTIFICATE OF CORRECTION

PATENT NO. : 8,779,987 B2
APPLICATION NO. : 13/279890
DATED : July 15, 2014
INVENTOR(S) : Natsumi Endo et al.

It is certified that error appears in the above-identified patent and that said Letters Patent is hereby corrected as shown below:

On the title page, Item (54) and in the specification, Column 1, the Title is incorrect. Item (54) and Column 1 should read:

--MULTIPLY RESONANT ANTENNA DEVICE AND ELECTRONIC DEVICE INCLUDING SUCH AN ANTENNA DEVICE--

Signed and Sealed this
Twenty-eighth Day of October, 2014

Michelle K. Lee

Michelle K. Lee
*Deputy Director of the United States Patent and Trademark Office*